United States Patent [19]

Lappi

[11] Patent Number: 4,959,933

[45] Date of Patent: Oct. 2, 1990

[54] CABIN UNIT ARRANGEMENT

[75] Inventor: Erkki Lappi, Espoo, Finland

[73] Assignee: Wärtsilä Meriteollisuus Oy, Helsinki, Finland

[21] Appl. No.: 196,976

[22] Filed: May 20, 1988

[30] Foreign Application Priority Data

May 27, 1987 [FI] Finland ..... 872341

[51] Int. Cl.[5] ..... B63B 29/02; E04B 1/348

[52] U.S. Cl. ..... 52/79.7; 52/234; 52/745; 114/77 R; 114/189

[58] Field of Search ..... 52/64, 66, 67, 79.1, 52/79.5, 79.9, 79.7; 114/65 R, 71, 77 R, 77 A, 189, 259, 344

[56] References Cited

U.S. PATENT DOCUMENTS

| | | | |
|---|---|---|---|
| 2,499,498 | 3/1950 | Hammond, Jr. | 52/67 |
| 3,421,268 | 1/1969 | Reynolds et al. | 52/70 |
| 3,792,558 | 2/1974 | Berce et al. | 52/79.5 |
| 3,866,365 | 2/1975 | Honigman | 52/70 |
| 4,075,814 | 2/1978 | Theurer et al. | 52/79.5 |
| 4,528,928 | 7/1985 | Virta et al. | 52/79.7 |
| 4,569,163 | 2/1986 | Long | 52/36 |

FOREIGN PATENT DOCUMENTS

| | | | |
|---|---|---|---|
| 3708278 | 9/1987 | Fed. Rep. of Germany . | |
| 75312 | 9/1988 | Finland . | |
| 2296738 | 7/1976 | France | 52/79.5 |
| 86/06341 | 11/1986 | Int'l Pat. Institute . | |
| 7208691 | 7/1975 | Sweden . | |
| 1326011 | 9/1969 | United Kingdom . | |
| 1600110 | 10/1981 | United Kingdom . | |
| 2188346 | 9/1987 | United Kingdom . | |

OTHER PUBLICATIONS

Spruth, "Vorgefertigte Wohneinheiten für Seescheffe", *Schiff and Hafen,* Feb. 1981, pp. 25–28.

Kverneland et al., "Automatisering av arbeidsprosesser innen skipsbyggerier" *The Ship Research Institute of Norway,* Apr. 1983.

*Primary Examiner*—Richard E. Chilcot, Jr.

*Attorney, Agent, or Firm*—Dellett, Smith-Hill and Bedell

[57] ABSTRACT

Cabin unit arrangement for ships or the like comprising a number of cabin units located side by side on an even base, for instance on a ships deck. Said cabin units are separately mountable, whereby the self-supporting and box-like cabin unit comprises at least walls and a roof and is arranged for transport to the cabin mounting site at least mainly as a unique transport unit. Said transport unit is produced from at least two basic elements, whereby at least one external dimension of the transport unit is considerably smaller than the corresponding extension of the mounted cabin unit.

16 Claims, 7 Drawing Sheets

CABIN UNIT ARRANGEMENT

BACKGROUND OF THE INVENTION

The invention relates to a cabin element arrangement and a method for the realization of the cabin element. The arrangement comprises a number of separately mounted cabin units located side by side on an even base. The self-supporting and box-like cabin unit comprises at least the walls and the roof and is intended to be moved to its installation site at least mainly as a unique transport unit.

The passenger compartment of a ship, accommodation or office rooms of an offshore construction, or the like portions are assembled by a number of different methods. The so-called on-site-method realized at the installation site includes usually a girder structure supported at the ship hull or at the deck. The cabin is assembled by attaching separate elements, to the girder for instance wall structure. This is a slow and complicated method in the cramped space between the decks. Moreover, the steel girder structure increases considerably the weight of the passenger compartment. The girder structure hampers possible later modification works of the passenger compartment, for instance a renovation of the entire passenger compartment, an alteration in the space arrangement etc.

In a more rationalized method prefabricated wall, roof or the like elements are used, which are delivered to the cabin assembly site on the ship as element packages, for instance. Attachment lists are welded to the floor, roof or intermediate bulkheads of the passenger compartment deck in order to attach the elements thereof. As an example of this technique is presented U.S. Pat. No. 2079635, West German Patent Application No. DE 3708278 and the Patent Cooperation Treaty Application No. WO 86/06341. A defect in this method is that furniture intended for fixed cabin installation cannot usually be attached, for instance, to cabin walls while building prefabricated members outside the ship. The bathroom-toilet is not connected with other elements of the cabin until the cabin is at the installation site. The prefabrication level of the cabin will hereby remain low and a considerable portion of the assembly and installation job must be done in the cramped area of the ship's deck, which decreases the efficiency of the job.

A third production method is the prefabrication of the cabin unit to an almost complete fabrication stage already at the prefabrication site. The invention is closely related to this technical area. The cabin unit is moved as a mainly unique entity to its installation site on the deck. Prior art is described in U.S. Pat. Nos. US 3363597, SE 377681, US 4091581, GB 1600110, in the journal "Schiff und Hafen" (Heft 2/1981 pages 25–28) and the report R-85.79. (Ship Research Institute of Norway). The movement of the stiff room unit, the cabin, is complicated in the cramped space between two decks. If for instance a transport pallet provided with wheels according to U.S. Pat. No. 2572348 is used, a cabin provided with a floor will be lifted considerably high up.

A considerable progress is possible by producing a self-supporting, floorless cabin unit (U.S. Pat. No. 4528928), which is lifted up very little above the deck when being moved along the ship's deck. By this means the required free vertical space is reduced. The problem in the prior art is the lateral extensions of the cabin unit prefabricated outside the ship. If a cabin unit is transported from the prefabrication site to the installation site, via roads or railway, the authority requirements restrict considerably the extension of the cabin unit at least in the transverse direction of transportation. Furthermore, the movement of the cabin unit from the pier to the ships deck and further to the mounting site requires an unobstructed passage route. The supporting pillars between the ship decks obstruct considerably the movement of the cabin unit, and the need to reserve an unobstructed passage route complicates the realization of other job stages, too. The construction of the main conduit system of the water and sewage systems of cabins located on different decks, for instance, must often be left to a later stage, in order to avoid the nuisance of main deck conduit pipes located on the deck restricting the cabin movement. A prior arrangement (U.S. Pat. No. 4037385) comprises a room element package without a roof, fixtures and wet room unit, which package can be stretched open. This construction is not suited for an arrangement with a goal for a high prefabrication stage.

The analysis of the prior art leading to the invention revealed that the most significant disadvantage was generated by lateral dimensions "length" and "width" of the cabin unit. By comparing plan drawings of the cabin unit and the ship deck it was found, that a decrease of the dimension by an amount of 0.5–1.2 meters is sufficient to eliminate most difficulties. The object of the invention is to provide a method and a cabin element arrangement, which fulfill this elimination.

SUMMARY OF THE INVENTION

The core of the invention is the surprising insight: it is possible to reduce the entity, intended to form the cabin unit, outside the ship in the lateral directions so, that the entity is stretchable on the cabin deck to correspond the desired final cabin unit dimensions.

The object of the invention is gained by fabricating a transport unit from at least two basic elements. During movement of the entity at least one external dimension is considerably smaller than the corresponding dimension of the installed cabin unit.

The transport unit comprises in a favorable cabin element arrangement a first and a second self-supporting cabin section and connecting members for the connection of the sections. The cabin sections, when mounted on the cabin mounting site, form the main wall periphery of the cabin unit and members for the realization of the roof main portion. This arrangement makes possible the change of one external dimension, for instance that of the "width" dimension.

Favorable connection members complete the wall periphery and the roof members of the sections, so that the entire wall periphery and the roof of the cabin unit can be realized. Connection members are, for instance, a cabin door wall member, a back wall member and roof members connecting the roof elements of the cabin sections. In an other realization the connection members comprise at least two side wall elements for the connection of the cabin sections. A number of roof members are applied for the connection of roof elements of said sections.

A piece of furniture intended for fixed mounting, for instance a bed, a table or the like, is located in one of the cabin sections of the transport unit regardless whether the piece of furniture extends in its final orientation to both cabin sections or only within the space of one section. Cable, wire, pipework or the like connections, are so adjusted, that they are located in the transport unit. The connections maintain hereby the connection routes between the sections. The ducts, panels or the like units for the electrical cables and wires are so realized, that at least a portion of the cables within the part corresponding the back wall member are located unhindered in the transport unit during the transport. These cable units are favorably in conjunction with the cabin back wall, whereby the back wall comprises for instance a removable panel. The unhindered cable portion makes possible in the cabin section a permanent mounting and connections for the main portion of the cable, although the cabin sections are to be moved relative to each other.

Fire extinguishing arrangements, for instance a sprinkler conduit and the nozzles, are located in the roof element of the cabin section.

The cabin element can be moved to its mounting site as a unitary transport unit, as known per se for instance, as a self-supporting cabin unit presented in U.S. Pat. No. 4528928. The core in the characteristics of the invention is in that a transport unit is created from at least two basic elements so, that at least one external dimension of the transport unit is smaller than the corresponding dimension of the installed cabin unit.

By creating the transport unit from two self-supporting cabin sections, which form the main periphery of the complete cabin unit and makes the realization of the roof main portion possible, one is able to produce the cabin unit by connecting the sections. One favorable measure is to stretch the transport unit in the stretching direction so, that a gap is generated between the first and second cabin section, and the gap extends from an opening provided for the door members of the cabin to an opening provided for back wall members. The complete cabin unit is larger than the transport unit by an the size of this gap in said stretching direction; minor adjustment motions can, naturally, exist when connecting the sections. The gap is formed to be at least 0.5 meters, preferably to be about 0.8–1.0 meters. The gap is directed mainly in the direction corresponding the transport direction of the transport unit. This is a favorable measure for road and railway transportation whereby the allowed transverse width of a vehicle load permits transportation of large transport units. In an other realization the gap is directed in the transverse cabin direction. This is very practical measure for loading a number of transport units on a transport vehicle, if the unaltered lateral dimension say "width", is already small enough.

The connection members are created by cabin door members and back wall members, or in the last-mentioned realization by two side wall elements, and the roof members connecting portion of the roof, which extends through the gap. Furthermore, the connection members comprise members, which connect and support said partial members at the sections. A very practical solution is to produce a transport unit from cabin sections comprising a mainly open bottom, whereby the sections are connected at their roof members and either at their side or end wall portions. The transport unit is created from mainly complete furnished cabin sections. Pieces of furniture, which in the cabin unit extend to both sections are movably supported in one of the sections of the transport unit. During the production of the cabin unit these pieces of fixtures are turned, moved or extended to both sections, for instance through telescopic stretching. The connecting members can be located inside the transport unit during the transport.

BRIEF DESCRIPTION OF THE DRAWINGS

The invention is described more in detail with reference to the attached drawing, in which FIG. 1 visualizes a general view of an embodiment of the invention, FIG. 2 visualizes the embodiment of FIG. 1 as a top view and partly sectioned, FIG. 3 visualizes the embodiment of FIG. 2 in an adjustment corresponding a transport unit, FIG. 4 and FIG. 5 visualize double cabin entities on a cabin deck, on the one hand as a transport unit realization and on the other hand as stretched out, FIG. 6 visualizes two self-supporting cabin sections.

DETAILED DESCRIPTION

Figure 1:
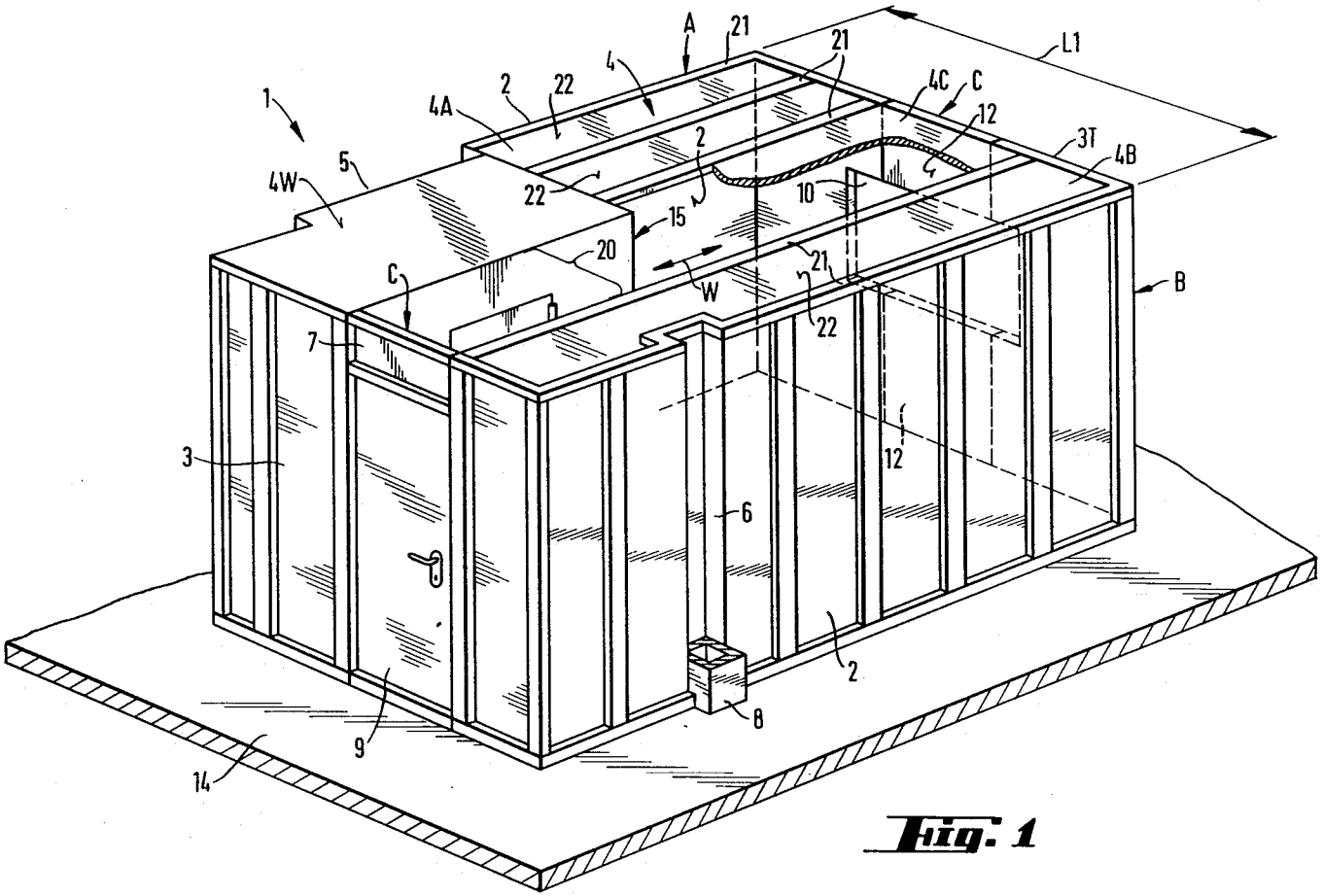

FIG. 1 visualize a self-supporting cabin unit 1, which comprises side walls 2, a door wall 3 and a back wall 3T. Cabin unit 1 is created from a first and a second cabin section A and B, which have roofs 4A and 4B. Roof 4A is formed by a roof 4W of a wet room element 15 (FIG. 2) and roof panels 22 directed along the longitudinal direction W. Roof 4B of section B is formed by one or several panels 22. Connecting members C, which connect sections A,B, are formed from a door wall member 7, a back wall member 12 and roof members 4C, which connect roof elements 4A and 4B together. A cabin door 9 is in conjunction with door wall 3. The ship's deck is marked with reference numeral 14, and the installed width of the cabin with reference numeral L1. In this arrangement, the main portion of roof 4 is formed by portions 4A and 4B.

Figure 2:
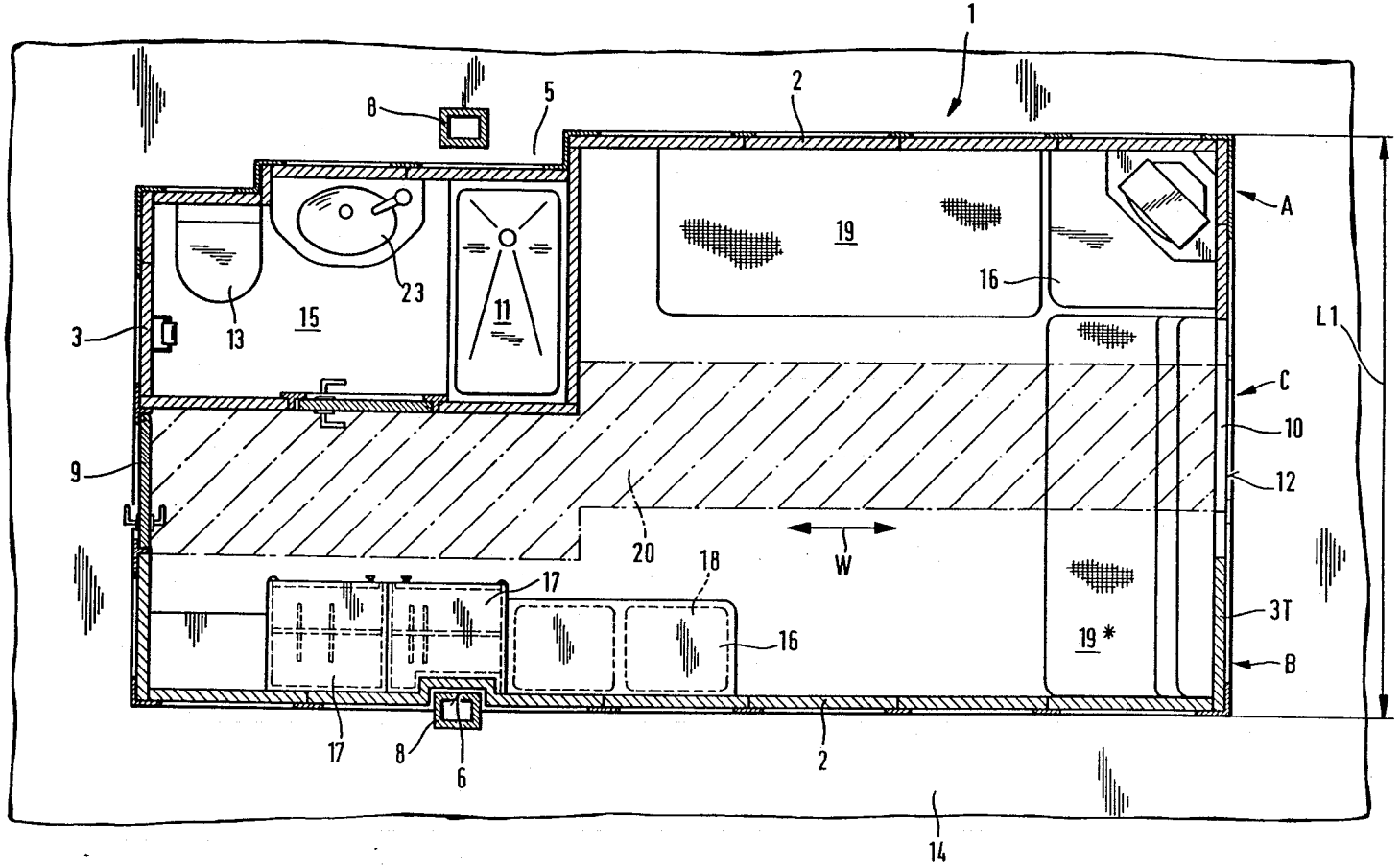

FIG. 2 visualizes as a top view a cabin unit intended for a pillar ship. Vertical channels 5 and 6 are arranged in conjunction with side walls 2 for pillars 8 (FIG. 4,5) located on deck 14. Wet room unit 15 comprises shower appliances 11 with a floor well, a wash basen 23 and a WC-seat 13. Cabin furniture pieces are a table 16 with its chair 18, a wardrobe 17 and a bed 19. Reference W refers to the cabin's longitudinal direction. The shaded gap 20 clarifies the difference between the extensions of the mounted cabin and the transport unit in direction L1.

Figure 3:
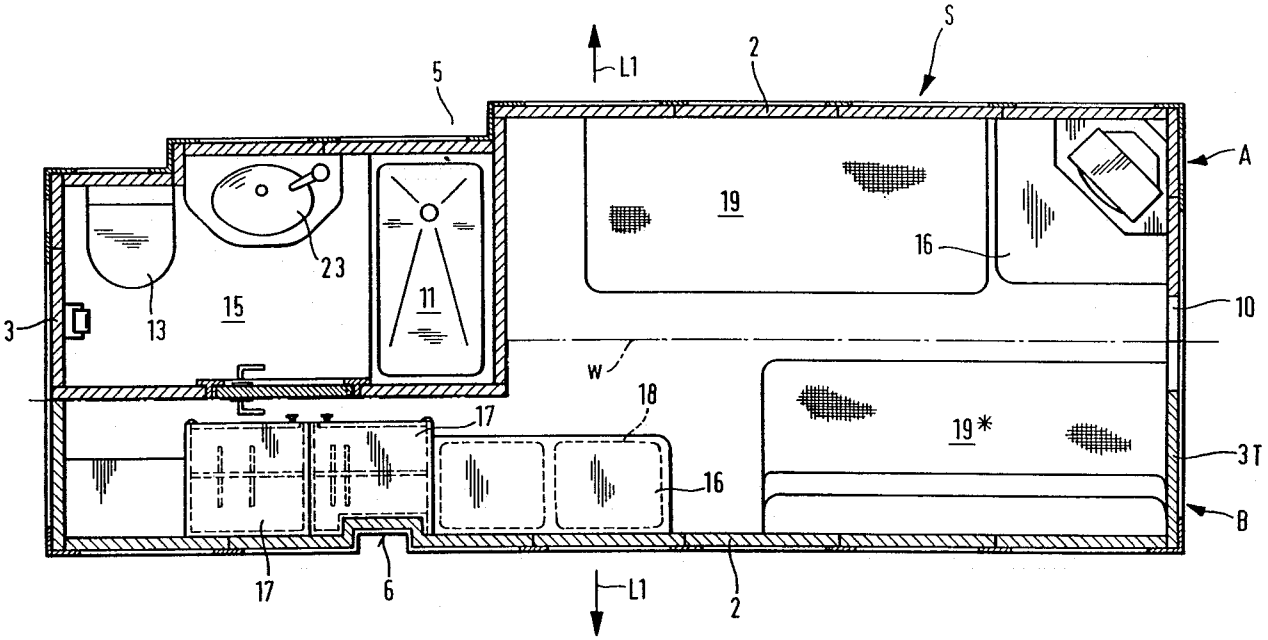

FIG. 3 visualizes a transport unit S corresponding the cabin unit according to FIG. 2. The second bed 19*, which in the installed cabin extends to both sections A and B, is located entirely in cabin section B of the transport units. A separation line w is between sections A and B.

Figure 4:
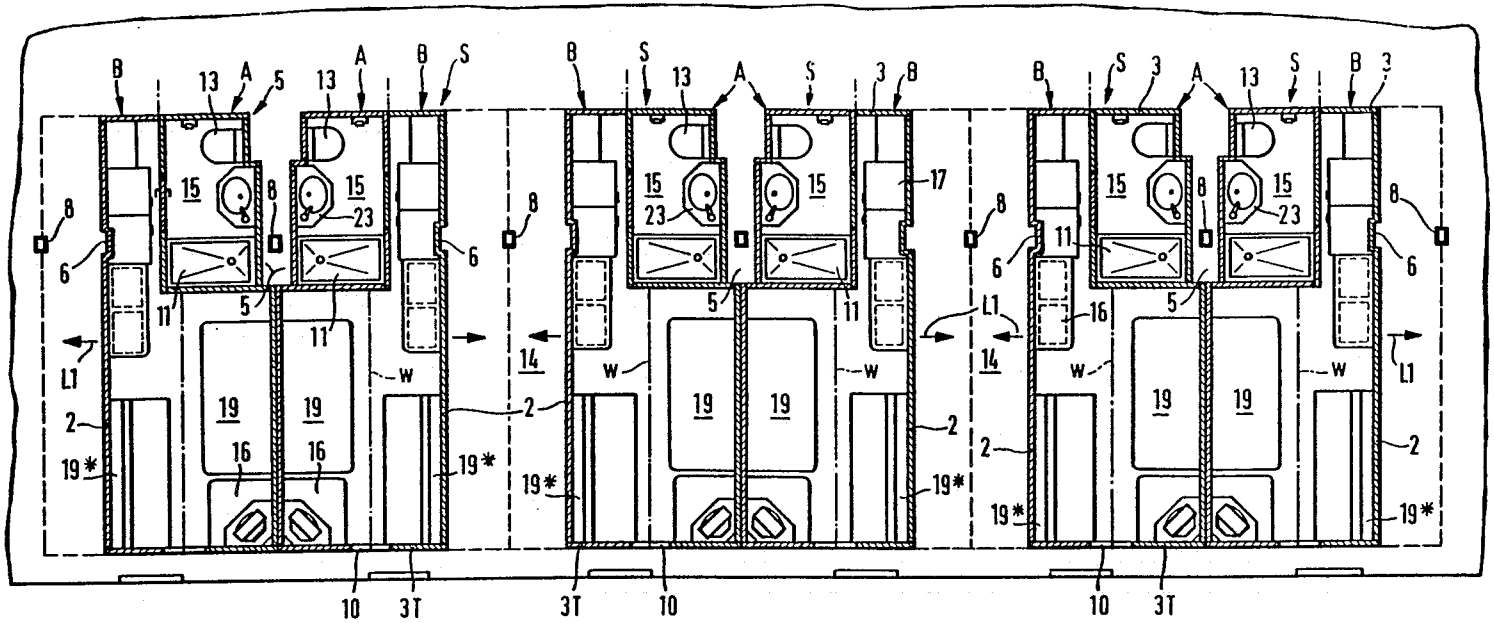
Figure 5:
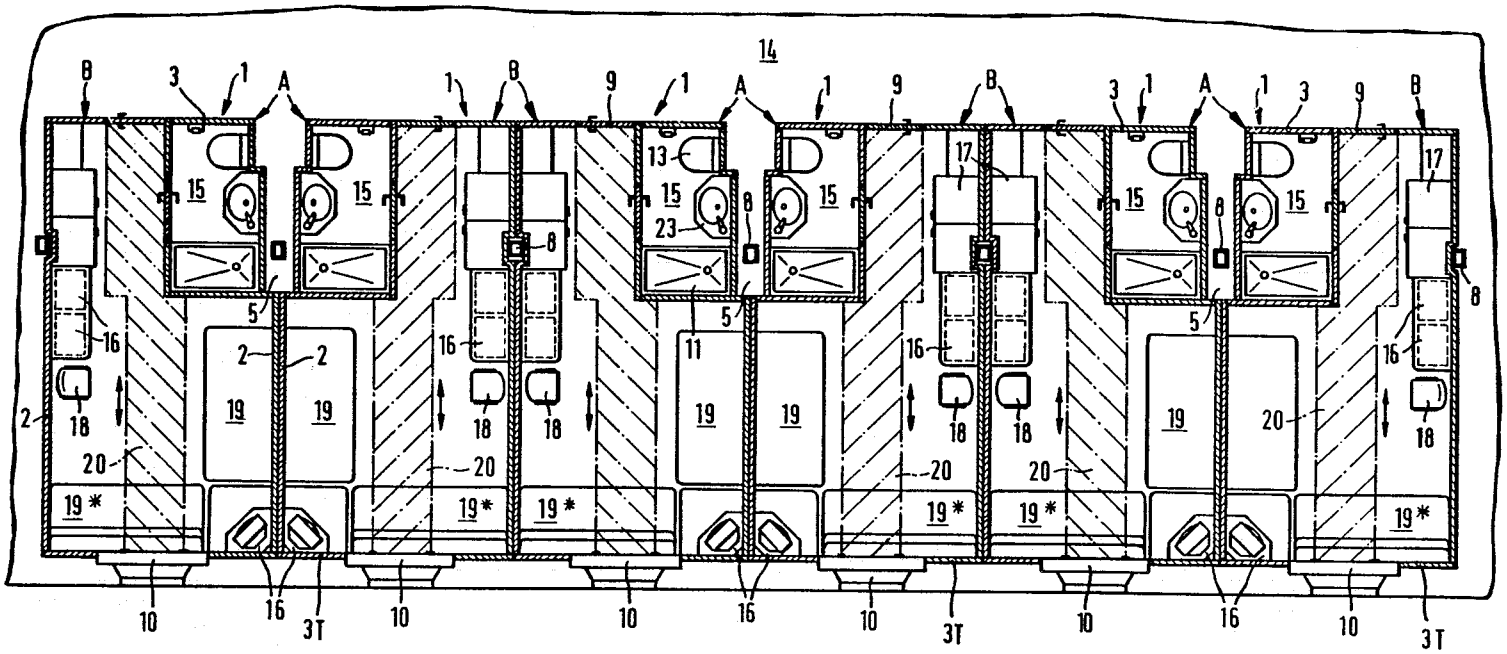

FIGS. 4 and 5 visualize the adjustment of transport units S, which were separately moved to deck 14, between pillars 8 and the stretching of transport unit in direction L. FIG. 5 visualizes a cabin window 10, which can be realized in the manner disclosed in the Finnish Patent Application No. 854964.

Figure 6:
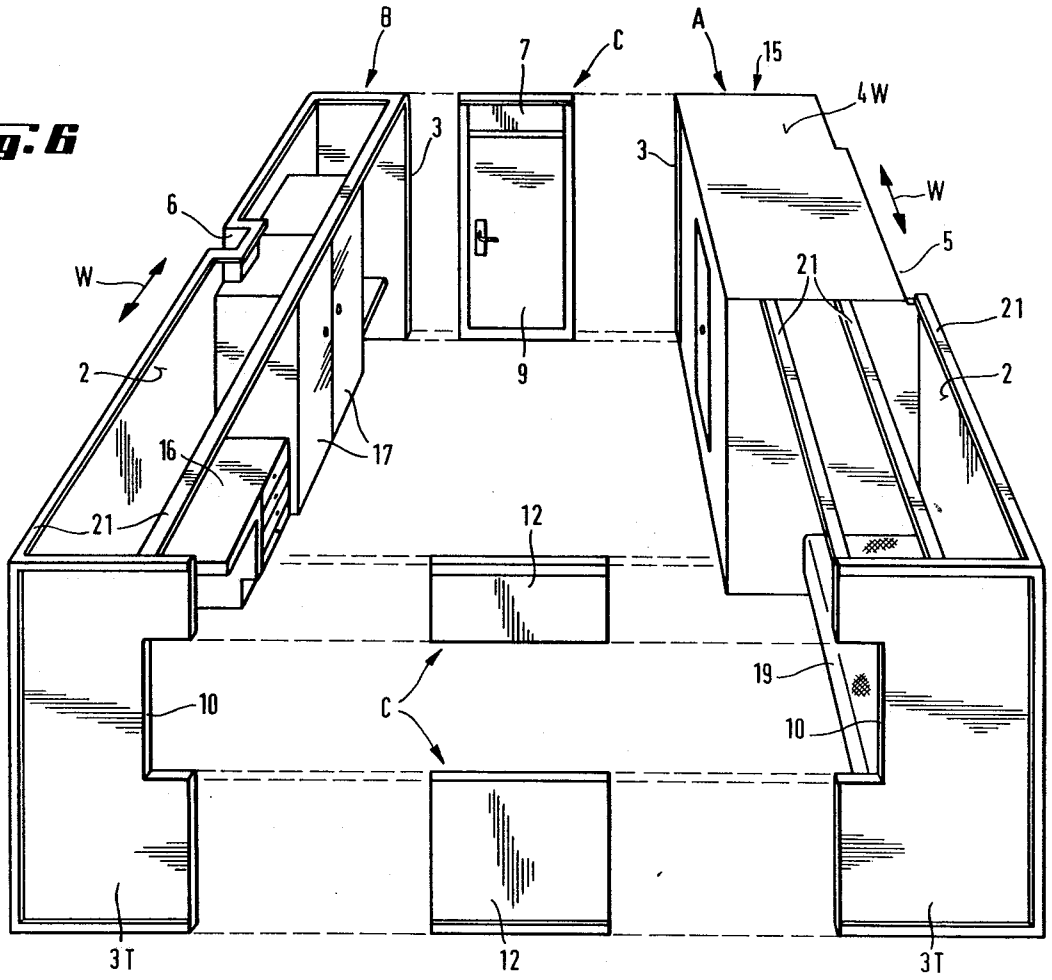

FIG. 6 visualizes a realization which differs from the cabin unit 1 of FIG. 1 by construction details of roof 4. Sections A and B of the transport unit are visualized looking from the direction of a window 10 of a future cabin unit 1. Both sections A and B can comprise its own, partial floor construction, whereby the floor portion corresponding the dimensions of gap 20 (see FIG. 2), can be covered with a separate floor member. As an other alternative is hereby noted a cabin unit with mainly open bottom (U.S. Pat. No. 4528928), whereby sections A and B need no floor portions as such. It is also possible to locate at least some of connection members (like back wall members 12, door member, separate roof panels, etc.) inside the transport unit during transportation. If suitably dimensioned, even the connecting roof member 4C (FIG. 1) can be held inside said unit. The main portion of section A (B), in the illustrated sections A and B, comprises beams 21 directed in the longitudinal direction W, by which the roof panels of an installed cabin are supported. The longitudinal direction of the roof panel is directed along direction L1 (FIG. 1). Each roof panel extends over the gap 20 in a basic embodiment. Furthermore the panels located near back wall 3T extend from one side wall 2 to the other side wall 2. The panels near door wall 3 extend from roof 4W of wet room 15 to one side wall 2. Roof portion 4W and beams 21, which one support the transverse panels, make the realization of the main portion of roof 4 possible.

The invention is not limited to the embodiments shown, but several modifications thereof are possible, for instance to produce roof 4 of cabin unit 1 from a prefabricated, unitary roof unit, which is intended to mainly cover that roof area, which is determined by section A and B and gap 20. Roof 4W of wet room unit 15 can through its edges hereby be connected with the unitary main roof unit.

The sprinkler arrangement with its nozzles, and located in conjunction with roof 4, can be realized by several different means. In an embodiment corresponding FIG. 1 said members are mounted, for instance, in one or several panels 22. In an embodiment according to FIG. 6 they can be attached, for instance, at beam 21.

Figure 7:
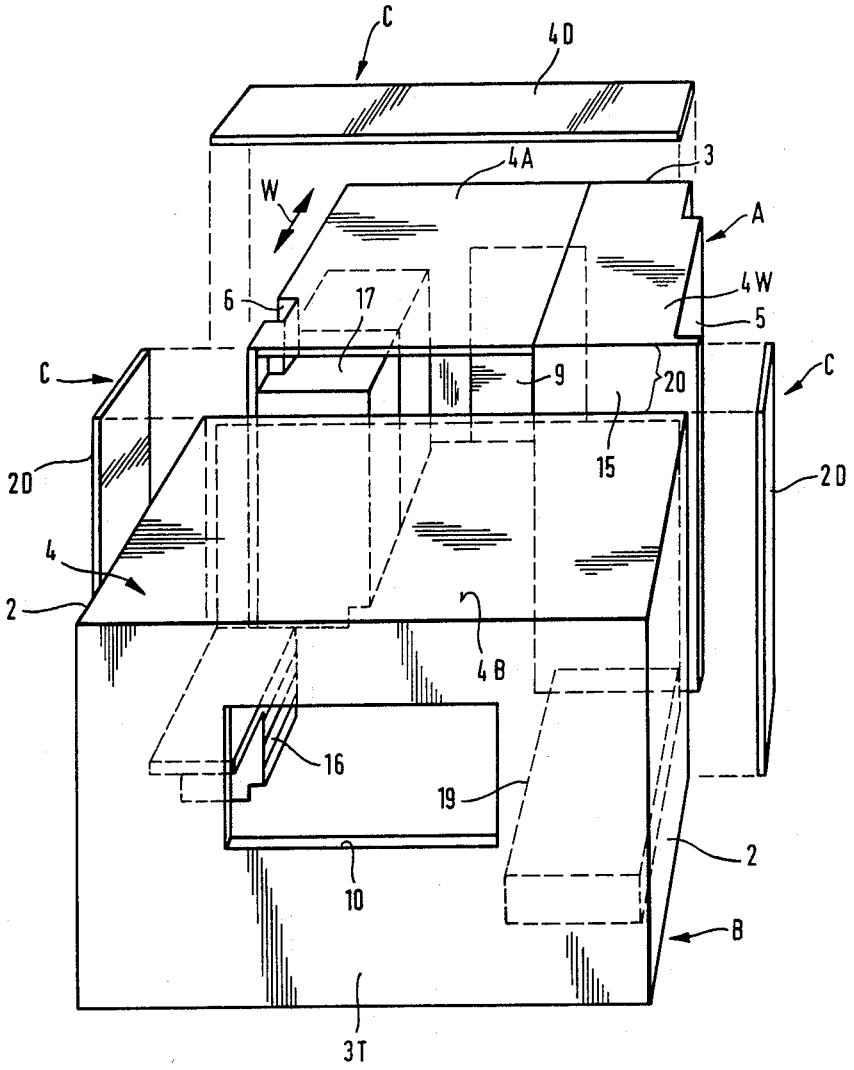
FIG. 7 visualizes another realization for two self-supporting cabin sections.

FIG. 7, for instance, illustrates a modification in which the lateral stretching is planned to be carried out in direction W. Cabin unit 1 is produced from sections A and B, door wall member and back wall member and connecting elements 2D and 4D. These members correspond those ones indicated by C in FIGS. 1 and 2. Member 2D is a side wall element and 4D a roof element; these elements are attached at sections A and B. These elements (2D,4D) can easily be located in the transport unit during the transport.

I claim:

1. A method for installing a cabin in a ship of the like, comprising the steps of:

(a) fabricating a transport unit at a fabrication site, the transport unit comprising first and second self supporting major parts each including two end wall portions and a side wall extending between the end wall portions, the side walls of the two major parts being insubstantially parallel opposed relationship and the end wall portions of the first part being at substantially the same distance from each other as the end wall portions of the second part, (b) transporting the transport unit from the fabrication site to an installation site, (c) separating said major parts of the transport unit while maintaining the side walls in substantially parallel opposed relationship, and (d) installing wall members between the end wall portions of the two major parts.

2. A method according to claim 1, wherein step (a) includes placing the wall members inside the transport unit at the fabrication site, and step (c) includes removing the wall members from the transportation unit at the installation site.

3. A method according to claim 1, wherein step (c) comprises separating the major parts of the transport unit by a distance of at least 0.5 m.

4. A method according to claim 3, wherein step (c) comprises separating the major parts of the transport unit by a distance in the range from about 0.8–1.0 m.

5. A method according to claim 1, wherein step (a) includes placing furniture elements inside the transport unit.

6. A method according to claim 5, further comprising:

(e) shifting at least some of the furniture elements to different positions.

7. A method according to claim 6, wherein at least one of the furniture elements is placed in step (a) so that it is wholly within the first major part of the transport unit, and step (e) includes shifting said one furniture element so that it extends partly in each of the first and second major parts.

8. A method according to claim 1, wherein the first and second major parts each include a roof portion, and the method further comprises:

(e) installing roof members between the roof portions of the first and second major parts.

9. A method according to claim 1, wherein step (b) comprises orienting the transport unit so that it is transported in a direction substantially perpendicular to the direction in which the major parts are separated in step (c).

10. A transport unit comprising first and second self supporting major parts, each including two end wall portions and a side wall extending between the end wall portions, the side walls of the two major parts being in substantially parallel opposed relationship and the end wall portions of the first part being at substantially the same distance from each other as the end wall portions of the second part, such that said major parts can be separated from one another while the side walls are maintained in substantially parallel opposed relationship, and wall members can be installed between the end wall portions of the two major parts to provide a cabin suitable for installation in a ship or the like.

11. A transport unit according to claim 10, further comprising furniture elements within the transport unit.

12. A transport unit according to claim 10, wherein each of said major parts includes a roof portion, and the transport unit comprises at least one roof member that can be installed between the roof portions of the first and second major parts when the major parts have been separated from each other.

13. A transport unit comprising first and second self supporting major parts, each including two end wall portions and a side wall extending between the end wall portions, the side walls of the two major parts being in substantially parallel opposed relationship and the end wall portions of the first part being at substantially the same distance from each other as the end wall portions of the second part, such that said major parts can be separated from one another while the side walls are maintained in substantially parallel opposed relationship, and the transport unit further comprising wall members that can be installed between the end wall portions of the two major parts to provide a cabin suitable for installation in a ship or the like.

14. A transport unit according to claim 13, wherein the wall members comprise at least a door wall member that can be installed between one end wall portion of the first major part and one end wall portion of the second major part, and a back wall member that can be installed between the other end wall portion of the first major part and the other end wall portion of the second major part.

15. A transport unit according to claim 13, further comprising furniture elements within the transport unit.

16. A transport unit according to claim 13, wherein each of said major parts includes a roof portion, and the transport unit comprises at least one roof member that can be installed between the roof portions of the first and second major parts when the major parts have been separated from each other.

* * * * *